US007062937B1

(12) United States Patent
Baker et al.

(10) Patent No.: US 7,062,937 B1
(45) **Date of Patent: *Jun. 20, 2006**

(54) PRODUCT DISPENSER

(75) Inventors: Bret Baker, Vacaville, CA (US); Juha K. Salmela, Citrus Heights, CA (US)

(73) Assignee: Automatic Bar Controls, Inc., Vacaville, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/976,621

(22) Filed: Oct. 29, 2004

Related U.S. Application Data

(63) Continuation of application No. 10/713,750, filed on Nov. 13, 2003, now Pat. No. 6,832,487.

(60) Provisional application No. 60/454,906, filed on Mar. 14, 2003.

(51) Int. Cl.
*B67D 5/62* (2006.01)

(52) U.S. Cl. ..... 62/389; 222/146.6

(58) Field of Classification Search ..... 62/314, 62/389, 415; 222/146.6, 95, 207, 214, 383.3
See application file for complete search history.

(56) References Cited

U.S. PATENT DOCUMENTS

| | | | | |
|---|---|---|---|---|
| 3,881,641 | A | 5/1975 | Plimi, Jr. et al. | |
| 3,889,487 | A | 6/1975 | Frankfurt | |
| 3,898,859 | A | 8/1975 | Duke | |
| 4,513,885 | A | 4/1985 | Hogan | |
| 4,515,294 | A | 5/1985 | Udall | |
| 4,690,307 | A | 9/1987 | Hogan | |
| 4,858,788 | A * | 8/1989 | Meckenstock | 222/207 |
| 4,895,276 | A | 1/1990 | Maldonado | |
| 4,911,331 | A | 3/1990 | Sedam | |
| 4,978,036 | A | 12/1990 | Burd | |
| 5,114,052 | A | 5/1992 | Tiramani et al. | |
| 5,197,866 | A * | 3/1993 | Kim | 417/472 |
| 5,224,627 | A * | 7/1993 | Weag | 222/135 |
| 5,255,822 | A | 10/1993 | Mease et al. | |
| 5,303,867 | A * | 4/1994 | Peterson | 239/333 |
| 5,335,819 | A * | 8/1994 | Martin | 222/146.6 |
| 5,346,098 | A * | 9/1994 | King et al. | 222/146.5 |
| 5,390,826 | A | 2/1995 | Burrows | |
| 5,398,845 | A * | 3/1995 | Meyer | 222/1 |

(Continued)

FOREIGN PATENT DOCUMENTS

GB 2180632 A 4/1987

(Continued)

*Primary Examiner*—Nohannad M. Ali
(74) *Attorney, Agent, or Firm*—Townsend and Townsend and Crew LLP

(57) ABSTRACT

Embodiments of the present invention are directed to a dispensing apparatus for dispensing a flowable product. In one embodiment, the apparatus comprises a dispenser housing having a product outlet extending from the dispenser housing to dispense the flowable product from the product package; and a bellows pump having a pump inlet, a pump outlet, and bellows disposed between the pump inlet and the pump outlet. The pump outlet is coupled to the product outlet of the dispenser housing. The pump inlet is configured to be coupled to the product package outlet of the product package. An actuation lever is coupled with the bellows pump. The actuation lever protrudes to an exterior of the dispensing housing and being movable to compress the bellows of the bellows pump in a compressed position and expand the bellows of the bellows pump in an extended position to pump the product from the product package to the product outlet. A resilient member is connected with the actuation lever to bias the actuation lever to one of the compressed position and the extended position.

22 Claims, 4 Drawing Sheets

U.S. PATENT DOCUMENTS

| | | | | | |
|---|---|---|---|---|---|
| 5,435,463 | A | * | 7/1995 | Hodgson | 222/105 |
| 5,439,140 | A | * | 8/1995 | Meyer | 222/110 |
| 5,465,877 | A | | 11/1995 | Bell et al. | |
| 5,537,825 | A | | 7/1996 | Ward | |
| 5,544,788 | A | * | 8/1996 | Meyer | 222/110 |
| 5,544,789 | A | * | 8/1996 | Gillingham | 222/153.13 |
| 5,597,093 | A | | 1/1997 | Lee | |
| 5,697,526 | A | | 12/1997 | Lee | |
| 5,699,669 | A | | 12/1997 | Gebhard | |
| 5,836,481 | A | | 11/1998 | Strohmeyer et al. | |
| 5,911,222 | A | * | 6/1999 | Lawrence et al. | 600/574 |
| 5,987,897 | A | | 11/1999 | Hall | |
| 6,068,162 | A | | 5/2000 | De Winter et al. | |
| 6,443,334 | B1 | * | 9/2002 | John et al. | 222/464.3 |
| 6,550,270 | B1 | | 4/2003 | Rudick | |
| 6,581,389 | B1 | | 6/2003 | Rudick | |
| 6,616,011 | B1 | | 9/2003 | Derry et al. | |
| 6,623,257 | B1 | * | 9/2003 | Taniguchi | 417/478 |
| 6,755,037 | B1 | | 6/2004 | Engel et al. | |

FOREIGN PATENT DOCUMENTS

| | | | | |
|---|---|---|---|---|
| GB | 2227302 | A | | 7/1990 |
| JP | 404383570 | A | | 12/1992 |
| JP | 5-306000 | A | * | 11/1993 |
| JP | 405285053 | A | | 11/1993 |
| JP | 6-183493 | A | * | 7/1994 |
| JP | 8-217167 | A | * | 8/1996 |
| JP | 2001-321087 | A | * | 11/2001 |

* cited by examiner

PRODUCT DISPENSER

CROSS-REFERENCES TO RELATED APPLICATIONS

This application is a continuation of U.S. patent application Ser. No. 10/713,750, filed Nov. 13, 2003 now U.S. Pat. No. 6,832,487, which is based on and claims the benefit of U.S. Provisional Patent Application No. 60/454,906, filed Mar. 14, 2003, the entire disclosures of which are incorporated herein by reference.

BACKGROUND OF THE INVENTION

The present invention relates generally to dispensing apparatus and, more particularly, to a dispensing apparatus for dispensing a flowable food product at a low temperature such as refrigerated creamer and the like.

Certain flowable food product need to be stored and dispensed at a low temperature (e.g., about 35–40° F.). There remains a need for an efficient, effective, sanitary, and easy-to-use apparatus for dispensing food products from packages at or below a preset low temperature. It is desirable to maintain the temperature of the food product at various locations from the package to the dispensing nozzle at or very close to the preset low temperature. In some cases, failure to do so may cause spoilage of the food product, or even pose health risks.

BRIEF SUMMARY OF THE INVENTION

Embodiments of the present invention are directed to a dispensing apparatus for dispensing a flowable product at or below a preset low temperature. The apparatus provides a refrigerated container including a cooling unit to cool the product package disposed therein, and a dispensing mechanism to pump the product from the product package to a dispensing nozzle. The cool air generated by the cooling unit in the refrigerated container is circulated around the product package and the dispensing mechanism to maintain the temperature of the product from the product package to the product outlet at or below a preset low temperature. The apparatus is desirably compact and energy efficient, and easy to maintain and use.

In accordance with an aspect of the present invention, an apparatus for dispensing a flowable product from a product package through a product outlet at or below a preset low temperature comprises a refrigerated container in which to dispose the product package. The container includes a gas outlet and a return gas inlet. A dispenser housing has a dispenser gas inlet coupled with the gas outlet of the refrigerated container to receive a cool gas from the refrigerated container, and a dispenser gas outlet coupled with the return gas inlet of the refrigerated container to return the cool gas to the refrigerated container. A product outlet extends from the dispenser housing to dispense the flowable product from the product package. A product flow line is disposed in the dispenser housing and coupled between the product package and the product outlet. An external surface of the product flow line is exposed to the cool gas in the dispenser housing from the refrigerated container flowing between the dispenser gas inlet and the dispenser gas outlet.

In some embodiments, the product flow line extends from the dispenser housing through the dispenser gas inlet of the dispenser housing to be coupled with the product package in the refrigerated container. A flow control device is configured to drive the cool gas from the refrigerated container through the gas outlet and the dispenser gas inlet into the dispenser housing and through the dispenser gas outlet and return gas inlet back into the refrigerated container. The flow control device may comprise a fan disposed in the refrigerated container generally between the gas outlet and the return gas inlet. A pump is coupled to the product flow line to pump the flowable product from the product package to the product outlet. The pump may comprise a bellows pump disposed in the dispenser housing. An actuation lever protrudes to an exterior of the dispenser housing which is movable by a user to actuate the bellows pump. The dispenser housing includes a flow channel guide which guides the cool gas to flow along substantially the entire external surface of the product flow line. The flow channel guide includes a return passage to guide the cool gas to the dispenser gas outlet.

In accordance with another aspect of this invention, an apparatus for dispensing a flowable product from a product package through a product outlet at or below a preset low temperature comprises a housing in which to dispose the product package. A cooling unit is configured to generate a cool gas in the housing to cool the product package disposed in the housing. A product flow line is disposed in the housing and coupled between the product package and a product outlet to dispense the flowable product from the product package. A flow channel guide is disposed in the housing to guide the cool gas to flow from a first region in the housing near the cooling unit to a second region in the housing near the product outlet along at least a portion of an external surface of the product flow line. The flow channel guide includes a return passage to guide the cool gas away from the product flow line back to the first region near the cooling unit. A flow control device is configured to drive the cool gas from the first region in the housing near the cooling unit to the second region near the product outlet and through the return passage back to the first region.

In accordance with another aspect of the invention, a method of dispensing a flowable product at or below a preset low temperature comprises disposing a product package in a container; generating a cool gas in the housing to cool the product package disposed in the housing; coupling a product flow line disposed in the housing between the product package and a product outlet; guiding the cool gas to flow from a cooling region in the housing near the product package to a dispensing region in the housing near the product outlet along at least a portion of an external surface of the product flow line, and away from the product flow line back to the cooling region near the product package; and providing a pump to pump the flowable product from the product package through the product flow line to the product outlet.

DETAILED DESCRIPTION OF THE INVENTION

Figure 1:
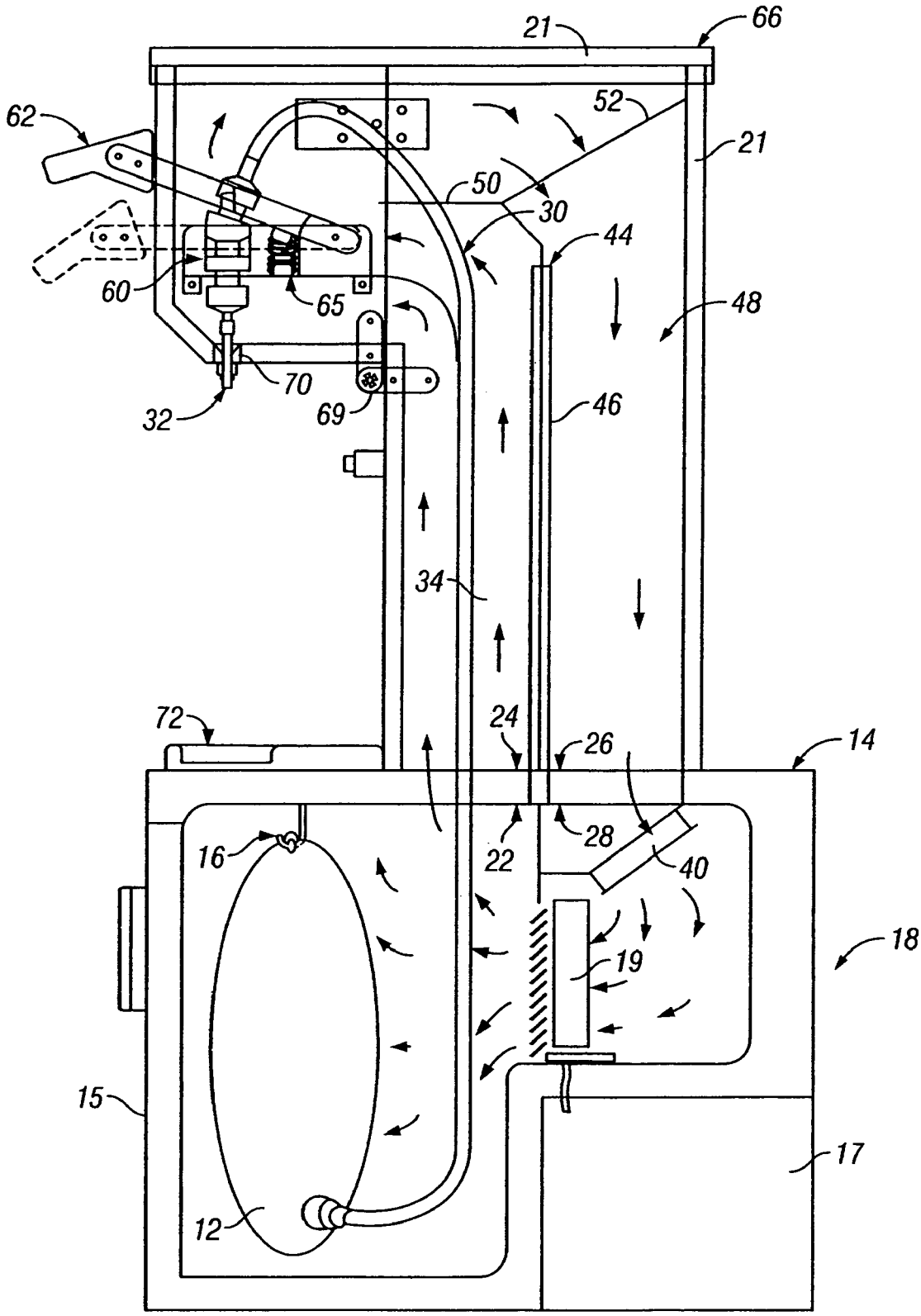
FIG. 1 is a partial cross-sectional side view of a dispensing apparatus according to an embodiment of the present invention.
Figure 2:
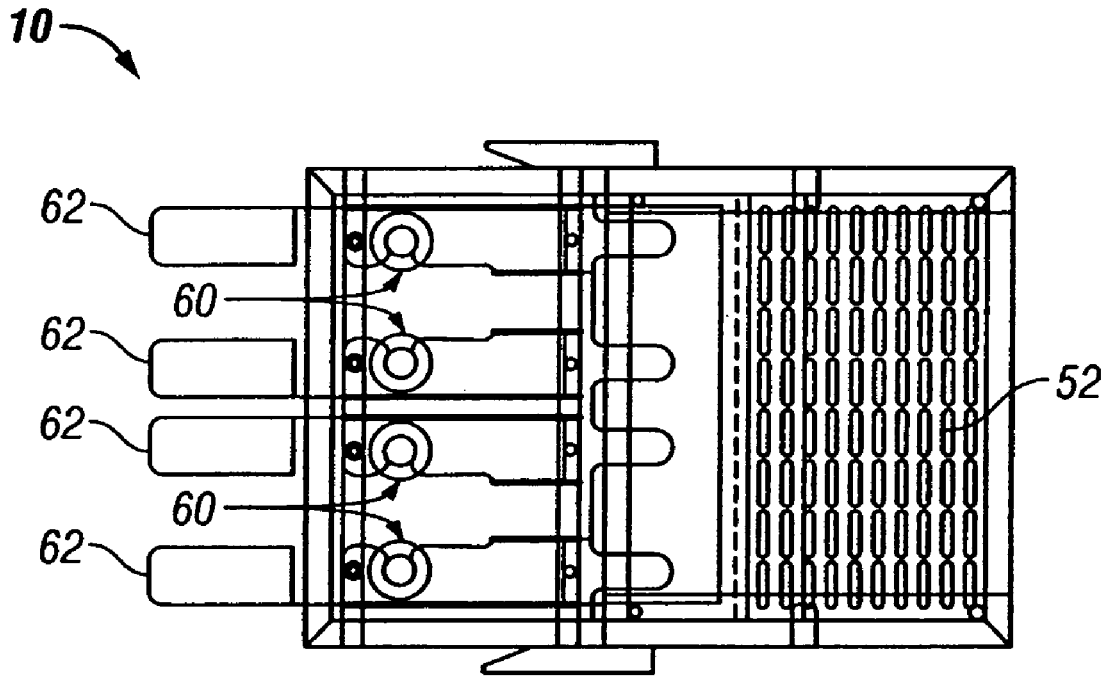
FIG. 2 is a top plan view of the dispensing apparatus of FIG. 1 with the top lid removed.

FIGS. 1–2 show a dispensing apparatus 10 for dispensing a flowable product contained in a product package 12 such as a bag or a carton. The product package 12 is disposed in a refrigerated container 14, which may be a small refrigerator with a door 15. In the embodiment shown, the product package 12 is hung by a hook 16. The refrigerated container 14 has a cooling unit 18 which cools the product package 12 and the gas or air inside the refrigerated container 14. In the embodiment shown, the cooling unit 18 includes a compressor 17 and an evaporator coil 19 with a drip pan and drain tube. The cool air is flowed from the refrigerated container 14 to a dispenser housing 20, and circulated through the dispenser housing 20 to maintain the temperature of the product at or below a preset low temperature. The dispenser housing 20 desirably includes thermal insulation 21 throughout. By hanging the product package 12, the cool air flows around the product package 12 to more effectively cool the product inside the package 12. The cool air flows out of the refrigerated container 12 through a gas outlet 22 into the dispenser housing 20 through a dispenser gas inlet 24, is circulated through the housing 20, and then flows out of the dispenser housing 20 through a dispenser gas outlet 26 and back into the refrigerated container 14 through a return gas inlet 28.

A product flow line 30 is coupled between the product package 12 and a product outlet 32 extending from the dispenser housing 20. The product outlet 32 may be a flexible nozzle tube. The product flow line 30 is typically a flexible tube which may be made of plastic. In the specific embodiment shown, the product flow line 30 extends through the gas outlet 22 of the refrigerated container 14 and the dispenser gas inlet 24 of the dispenser housing 20. The external surface of the product flow line 30 is exposed to the cool air flowing from the refrigerated container 14 to the dispenser housing 20.

A flow control device 40 is used to drive the cool air from the refrigerated container 14 through the gas outlet 22 and dispenser gas inlet 24 into the dispenser housing 20, and through the dispenser gas outlet 26 and return gas inlet 28 back into the refrigerated container 14. The flow control device 40 may include a fan disposed generally between the gas outlet 22 and the return gas inlet 28. The fan 40 generates a positive pressure on the side of the refrigerated container 14 having the gas outlet 22 and a negative pressure on the side of the refrigerated container 14 having the return gas inlet 28, thereby creating the recirculation air flow between the refrigerated container 14 and the dispenser housing 20.

The dispenser housing 20 includes a flow channel guide 44 which guides the cool air to circulate through the dispenser housing 20 between the dispenser gas inlet 24 and the dispenser gas outlet 26. As seen in FIG. 1, the flow channel guide 44 includes a divider 46 that guides that cool air to flow from the dispenser gas inlet 24 along an inlet passage 34 around the product flow line 30 on one side of the housing 20, and toward the dispenser gas outlet 26 along a return passage or duct 48 on the other side of the housing 20. The flow channel guide 44 further includes a deflector 50 which deflects the cool air toward the product outlet 32 to flow along substantially the entire external surface of the product flow line 30 to cool the product inside the product flow line 30. A perforated plate 52 may be provided at or near the entrance of the return duct 48. The recirculated air returns to the refrigerated container 14 and is cooled by the cooling unit 18. Thus, the cool gas flows from a cooling region near the product package 12 or the cooling unit 18 along the product flow line 30 to a dispensing region near the product outlet 32, and then away from the product flow line 30 back to the cooling region via the return duct 48 where the recirculated air is cooled by the cooling unit 18.

Figure 3:
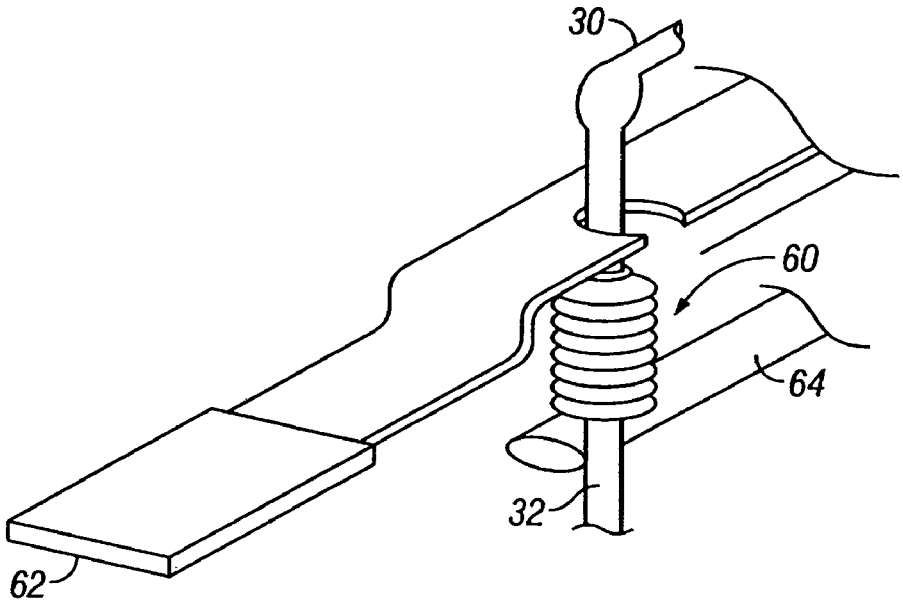
FIG. 3 is a simplified perspective view schematically illustrating the pump in the dispensing apparatus of FIG. 1.
Figure 4:
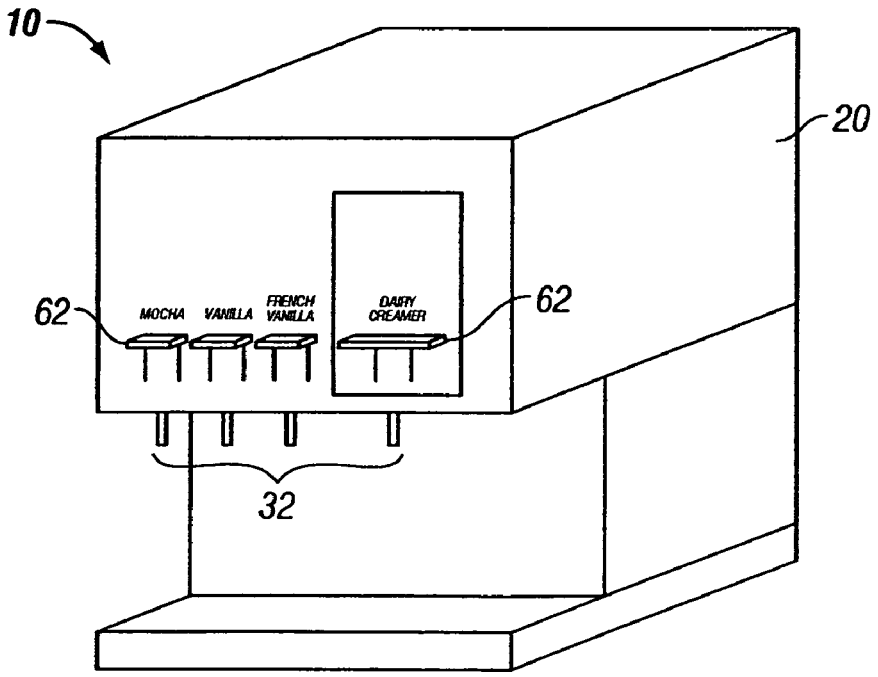
FIG. 4 is a perspective view of the dispensing apparatus of FIG. 1.

A pump 60 is provided to pump the flowable product from the product package 12 through the product flow line 30 to the product outlet 32. In the embodiment shown in FIG. 1, the pump is a bellows pump 60 which is configured to be manually operated by moving an actuation lever 62. The bellows pump 60 is disposed in the dispenser housing 20 and coupled to the product flow line 30. As illustrated in FIGS. 1 and 3, the bellows pump 60 is supported by a slot of a pump mounting bracket 64 which is attached to the dispenser housing 20, and the actuation lever 62 is rotatably mounted on the pump mounting bracket 64 to pivot and actuate the bellows pump 60. The actuation lever 62 protrudes to the exterior of the dispenser housing 20 to allow the user to move the actuation lever 62 to actuate the pump 60. A resilient member such as a return spring 65 is connected between the pump mounting bracket 64 and the actuation lever 62 to bias the actuation lever 62 to an extended position where the bellows pump 60 is extended. The actuation lever 62 is movable to a compressed position to compress the bellows pump 60. The product flows from the product package 12 through the product flow line 30 and the pump 60 to the product outlet 32. The bellows pump may be a disposable pump available from Hayakawa-Sanki of Tokyo, Japan.

Figure 1A:
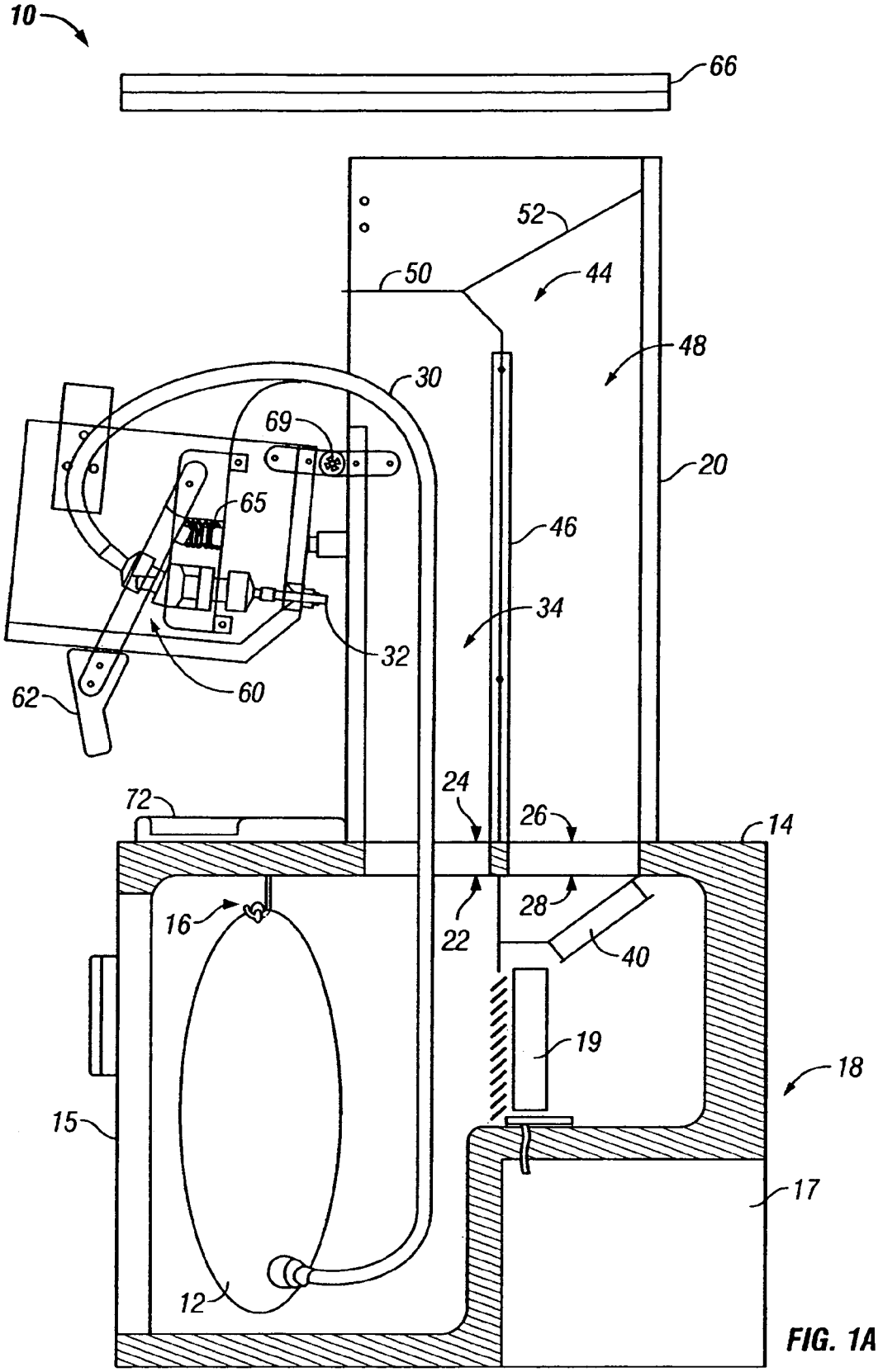
FIG. 1*a* is an exploded, partial cross-sectional side view of the dispensing apparatus of FIG. 1 showing the top lid removed and the housing in an open position.

The apparatus 10 is easy to assemble and disassemble. The top cover or lid 66 is removable and the portion of the housing 20 supporting the pump 60 is movable to an open position via a hinge 69, as seen in FIG. 1*a*. To set up the dispensing apparatus 10, one end of the product flow line 30 is dropped into the dispenser housing 20 and inserted into the refrigerated container 14 through the gas outlet 22 of the container 14. The other end of the product flow line 30 is connected to the bellows pump 60. The product outlet or nozzle tube 32 is connected to the bellows pump 60, and is attached to the dispenser housing 20 to protrude from the housing 20. This may be accomplished by inserting the nozzle tube 32 through a funneled opening 70 of the dispenser housing 20 below the pump mounting bracket 64. A drip tray 72 may be provided below the product outlet 32. The bellows pump 60 is slid sideways into the slot of the pump mounting bracket 64 and coupled with the actuation lever 62. The product package 12 is disposed in the refrigerated container 14, and the product flow line 30 is connected to the opening of the product package 12 after removal of the sanitary seals. The pump 60 is primed by pumping the actuation lever 62 until the product flows out of the product outlet 32.

To replace the product package 12, the pump 60 is disengaged from the pump mounting bracket 64 and the actuation lever 62, and the product outlet tube 32 is removed from the opening 70 of the housing 20. The pump 60, the product outlet tube 32, and the product flow line 30 are dropped into the refrigerated container 14 through the gas outlet 22. The door 15 of the container 14 is opened, and the product package 12 is pulled out with the pump 60, the product outlet tube 32, and the product flow line 30. The product package 12 is discarded and another product package is placed inside the refrigerated container 14. The pump 60, the product outlet tube 32, and the product flow line 30 may be cleaned if necessary, and or may be disposable and discarded after each use.

The above-described arrangements of apparatus and methods are merely illustrative of applications of the principles of this invention and many other embodiments and modifications may be made without departing from the spirit and scope of the invention as defined in the claims. For example, FIGS. 2 and 3 show an embodiment of the apparatus 10 in which four dispenser sets of pumps, product flow lines, and product packages are housed in the dispenser housing and refrigerated container. In another embodiment, fewer or more than four dispenser sets of pumps, product flow lines, and product packages may be disposed in the same unit of dispenser housing and refrigerated container. Furthermore, while the embodiment shown has a refrigerated container and a dispenser housing, a single housing in another embodiment may be used to contain and cool the product package and the dispenser sets or mechanisms. The scope of the invention should, therefore, be determined not with reference to the above description, but instead should be determined with reference to the appended claims along with their full scope of equivalents.

What is claimed is:

1. An apparatus for dispensing a flowable product from a product package through a product package outlet, the apparatus comprising:

a dispenser housing having a product outlet extending from the dispenser housing to dispense the flowable product from the product package;

a bellows pump having a pump inlet, a pump outlet, and bellows disposed between the pump inlet and the pump outlet, the pump outlet being coupled to the product outlet of the dispenser housing, the pump inlet configured to be coupled to the product package outlet of the product package;

an actuation lever coupled with the bellows pump, the actuation lever protruding to an exterior of the dispensing housing and being movable to compress the bellows of the bellows pump in a compressed position and expand the bellows of the bellows pump in an extended position to pump the product from the product package to the product outlet; and a pump mounting bracket attached to the dispenser housing, wherein the bellows pump is supported by a slot of the pump mounting bracket;

wherein the pump mounting bracket is attached to a movable portion of the dispenser housing which is movable between a closed position and an open position via a hinge to expose the pump mounting bracket and bellows pump in the open position and allow the pump mounting bracket and bellows pump to be accessed from outside the dispenser housing, the dispenser housing enclosing the pump mounting bracket and bellows pump with the movable portion of the dispenser housing in the closed position.

2. The apparatus of claim 1 further comprising a resilient member connected with the actuation lever to bias the actuation lever to one of the compressed position and the extended position.

3. The apparatus of claim 1 wherein the movable portion of the dispenser housing is disposed on a side with the product outlet oriented downward below the bellows pump, and wherein the hinge is disposed below the bellows pump.

4. The apparatus of claim 1 wherein the dispenser housing includes a lid to support the movable portion of the dispenser housing in the closed position.

5. The apparatus of claim 1 wherein the actuation lever is rotatably mounted on the pump mounting bracket to pivot and actuate the bellows pump.

6. The apparatus of claim 1 further comprising a product flow line configured to be connected between the pump inlet of the bellows pump and the product package outlet.

7. The apparatus of claim 2 wherein the resilient member comprises a return spring connected between the pump mounting bracket and the actuation lever.

8. The apparatus of claim 1 wherein the bellow pump is disposable.

9. The apparatus of claim 1 further comprising:

a cooling unit configured to generate a cool gas in the dispenser housing to cool the product package disposed in the dispenser housing; and a product flow line disposed in the dispenser housing and configured to be coupled between the product package outlet and the pump inlet to dispense the flowable product from the product package.

10. The apparatus of claim 9 further comprising a flow channel guide disposed in the dispenser housing to guide the cool gas to flow from a first region in the dispenser housing near the cooling unit to a second region in the dispenser housing near the product outlet along at least a portion of an external surface of the product flow line, the flow channel guide including a return passage to guide the cool gas away from the product flow line back to the first region near the cooling unit.

11. The apparatus of claim 10 further comprising a flow control device configured to drive the cool gas from the first region in the dispenser housing near the cooling unit to the second region near the product outlet and through the return passage back to the first region.

12. An apparatus for dispensing a flowable product from a product package through a product package outlet, the apparatus comprising:

a dispenser housing having a product outlet extending from the dispenser housing to dispense the flowable product from the product package;

a bellows pump having a pump inlet, a pump outlet, and bellows disposed between the pump inlet and the pump outlet, the pump outlet being coupled to the product outlet of the dispenser housing, the pump inlet configured to be coupled to the product package outlet of the product package;

a pump mounting bracket attached to the dispenser housing, the bellows pump being supported by the pump mounting bracket; and means coupled with the bellows pump and the pump mounting bracket for moving the bellows of the bellows pump between a compressed position and an extended position to pump the product from the product package to the product outlet;

wherein the pump mounting bracket is attached to a movable portion of the dispenser housing which is movable between a closed position and an open position via a hinge to expose the pump mounting bracket and bellows pump in the open position and allow the pump mounting bracket and bellows pump to be accessed from outside the dispenser housing, the dispenser housing enclosing the pump mounting bracket and bellows pump with the movable portion of the dispenser housing in the closed position.

13. The apparatus of claim 12 further comprising resilient means for biasing the bellows pump to the extended position.

14. The apparatus of claim 12 wherein the movable portion of the dispenser housing is disposed on a side with the product outlet oriented downward below the bellows pump, and wherein the hinge is disposed below the bellows pump.

15. The apparatus of claim 14 wherein the dispenser housing includes a lid to support the movable portion of the dispenser housing in the closed position.

16. The apparatus of claim 12 further comprising:

a cooling unit configured to generate a cool gas in the dispenser housing to cool the product package disposed in the dispenser housing; and a product flow line disposed in the dispenser housing and configured to be coupled between the product package outlet and the pump inlet to dispense the flowable product from the product package.

17. The apparatus of claim 16 further comprising a flow channel guide disposed in the dispenser housing to guide the cool gas to flow from a first region in the dispenser housing near the cooling unit to a second region in the dispenser housing near the product outlet along at least a portion of an external surface of the product flow line, the flow channel guide including a return passage to guide the cool gas away from the product flow line back to the first region near the cooling unit.

18. The apparatus of claim 17 further comprising a flow control device configured to drive the cool gas from the first region in the dispenser housing near the cooling unit to the second region near the product outlet and through the return passage back to the first region.

19. An apparatus for dispensing a flowable product from a product package through a product package outlet, the apparatus comprising:

a dispenser housing having a product outlet extending from the dispenser housing to dispense the flowable product from the product package;

a bellows pump having a pump inlet, a pump outlet, and bellows disposed between the pump inlet and the pump outlet, the pump outlet being coupled to the product outlet of the dispenser housing, the pump inlet configured to be coupled to the product package outlet of the product package;

an actuation lever coupled with the bellows pump, the actuation lever protruding to an exterior of the dispensing housing and being movable to compress the bellows of the bellows pump in a compressed position and expand the bellows of the bellows pump in an extended position to pump the product from the product package to the product outlet;

a resilient member connected with the actuation lever to bias the actuation lever to one of the compressed position and the extended position;

a cooling unit configured to generate a cool gas in the dispenser housing to cool the product package disposed in the dispenser housing;

a product flow line disposed in the dispenser housing and configured to be coupled between the product package outlet and the pump inlet to dispense the flowable product from the product package; and a flow channel guide disposed in the dispenser housing to guide the cool gas to flow from a first region in the dispenser housing near the cooling unit to a second region in the dispenser housing near the product outlet along at least a portion of an external surface of the product flow line, the flow channel guide including a return passage to guide the cool gas away from the product flow line back to the first region near the cooling unit.

20. The apparatus of claim 19 further comprising a flow control device configured to drive the cool gas from the first region in the dispenser housing near the cooling unit to the second region near the product outlet and through the return passage back to the first region.

21. An apparatus for dispensing a flowable product from a product package through a product package outlet, the apparatus comprising:

a dispenser housing having a product outlet extending from the dispenser housing to dispense the flowable product from the product package;

a bellows pump having a pump inlet, a pump outlet, and bellows disposed between the pump inlet and the pump outlet, the pump outlet being coupled to the product outlet of the dispenser housing, the pump inlet configured to be coupled to the product package outlet of the product package;

a pump mounting bracket attached to the dispenser housing, the bellows pump being supported by the pump mounting bracket;

means coupled with the bellows pump and the pump mounting bracket for moving the bellows of the bellows pump between a compressed position and an extended position to pump the product from the product package to the product outlet;

a cooling unit configured to generate a cool gas in the dispenser housing to cool the product package disposed in the dispenser housing;

a product flow line disposed in the dispenser housing and configured to be coupled between the product package outlet and the pump inlet to dispense the flowable product from the product package; and a flow channel guide disposed in the dispenser housing to guide the cool gas to flow from a first region in the dispenser housing near the cooling unit to a second region in the dispenser housing near the product outlet along at least a portion of an external surface of the product flow line, the flow channel guide including a return passage to guide the cool gas away from the product flow line back to the first region near the cooling unit.

22. The apparatus of claim 21 further comprising a flow control device configured to drive the cool gas from the first region in the dispenser housing near the cooling unit to the second region near the product outlet and through the return passage back to the first region.

* * * * *